US005728256A

United States Patent [19]

Schulz et al.

[11] Patent Number: 5,728,256

[45] Date of Patent: Mar. 17, 1998

[54] SMOOTH PRESS FOR A MACHINE FOR MANUFACTURING CORRUGATED CARDBOARD

[75] Inventors: Jens Schulz, Hamburg; Nicolaus Goerrissen, Elmshorn, both of Germany

[73] Assignees: Peters Maschinenfabrik GmbH, Hamburg, Germany; Bobst SA, Lausanne, Switzerland

[21] Appl. No.: 632,613

[22] Filed: Apr. 15, 1996

[30] Foreign Application Priority Data

Apr. 24, 1995 [CH] Switzerland ..... 01158/95

[51] Int. Cl.[6] ..... B31F 1/28

[52] U.S. Cl. ..... 156/472; 156/205; 156/210; 156/473

[58] Field of Search ..... 156/472, 473, 156/471, 205, 210, 583.5, 583.3; 100/154, 156, 151

[56] References Cited

U.S. PATENT DOCUMENTS

| | | | |
|---|---|---|---|
| 3,753,838 | 8/1973 | Brandenburg | 156/470 |
| 3,974,026 | 8/1976 | Emson et al. | 100/154 |
| 4,481,066 | 11/1984 | Hirakawa et al. | 156/472 |
| 5,344,520 | 9/1994 | Seki et al. | 156/205 |
| 5,449,431 | 9/1995 | Isowa | 156/472 |
| 5,512,020 | 4/1996 | Yasui | 156/473 |
| 5,526,739 | 6/1996 | Lauderbaugh et al. | 156/583.5 |
| 5,630,903 | 5/1997 | Knorr et al. | 156/472 |

FOREIGN PATENT DOCUMENTS

| | | |
|---|---|---|
| 0 623 459 | 5/1993 | European Pat. Off. . |
| 2142591 | 2/1973 | France . |
| 2 708 011 | 1/1995 | France . |
| 21 08 378 | 8/1972 | Germany . |
| 25 27 819 | 12/1976 | Germany . |
| 44 39 875 | 5/1995 | Germany . |

*Primary Examiner*—Michele K. Yoder
*Attorney, Agent, or Firm*—Hill, Steadman & Simpson

[57] ABSTRACT

A smooth press implements the application of a covering paper against a corrugated paper passing around a ribbed cylinder or roll of a single corrugator. The smooth press comprises a series of identical support arrangements arranged side-by-side along the ribbed cylinder or roll. Each arrangement has a pad whose support surface is urged against the ribbed cylinder and is curved according to a radius approximately equal to that of the ribbed cylinder in order to cover a plurality of ribs. Each pad is movable between a position disengaged from the corrugated paper and a second position biasing the cover sheet onto the corrugated paper on said ribbed cylinder and is movable individually in a controlled fashion.

17 Claims, 3 Drawing Sheets

FIG. 2
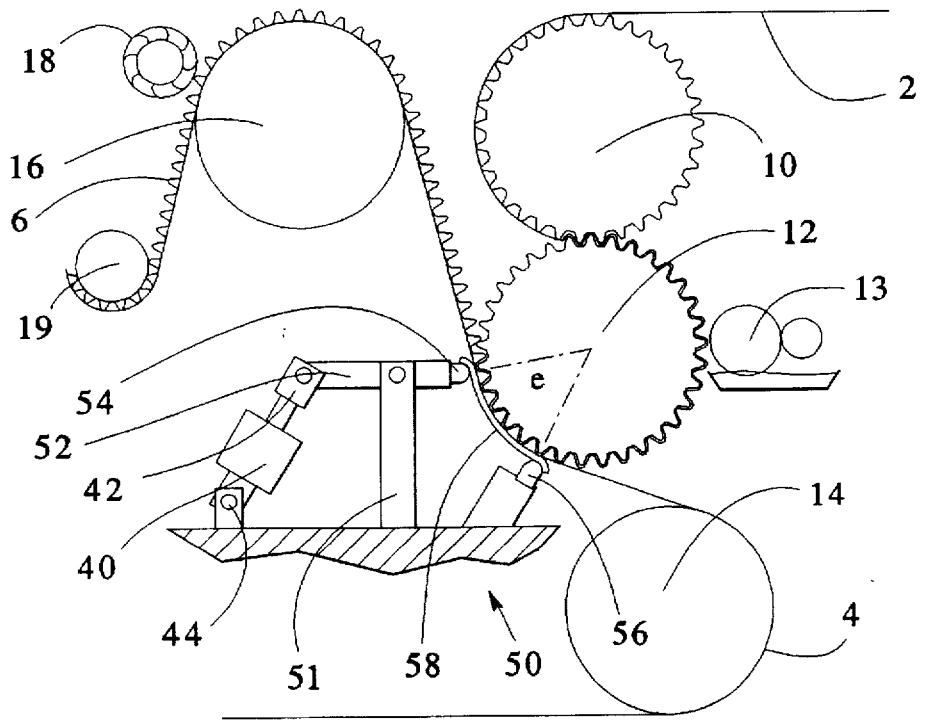
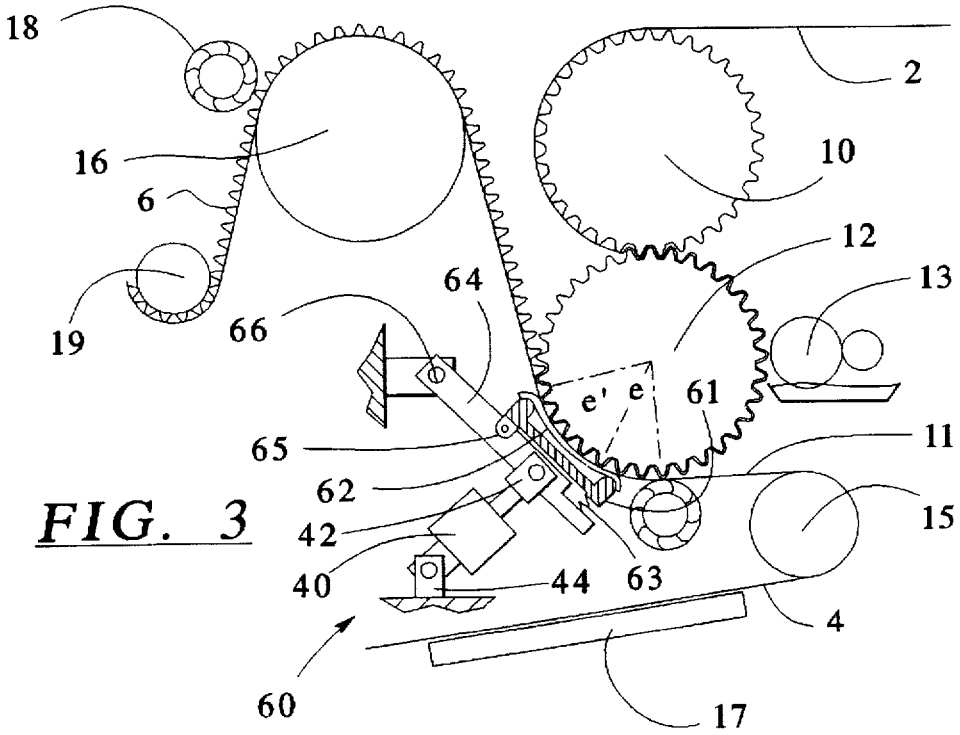
FIG. 3

SMOOTH PRESS FOR A MACHINE FOR MANUFACTURING CORRUGATED CARDBOARD

BACKGROUND OF THE INVENTION

The present invention is directed to a smooth press in a machine for manufacturing corrugated cardboard, which is a so-called single-sided machine and makes a sheet of corrugated paper of which the ridges are glued to a first covering sheet. This intermediate piece of cardboard is also called single-sided. In the subsequent machine, called double-sided, this first piece of cardboard is either assembled directly to a second exterior sheet of covering paper in order to produce a piece of cardboard called a double-sided cardboard or is assembled to a second single-sided piece of cardboard in order to obtain a final piece of cardboard called a double-double.

In a single-sided machine, the corrugated paper is pre-heated and humidified before passing between two ribbed cylinders heated with steam. The ribbed cylinders have meshing ribs which corrugate the sheet of paper. The corrugation thus produced is held against the lower ribbed cylinder by means of combs or by a system of excess pressure from an exterior environment or by a partial vacuum system from the interior of the lower ribbed cylinder, whose surface presents communication slits with grooves. A glue-spreading roller, which is steeped in a tub of glue, deposits a predetermined quantity of glue on the ridges or crests of the corrugations. The covering paper, also pre-heated, and the corrugated paper are then finally assembled by pressure between the lower ribbed cylinder and a supporting arrangement called a smooth press.

The most commonly used smooth press is made of a smooth cylinder or roller extending parallel to the lower ribbed cylinder and supported to be biased thereagainst. These two cylinders rotate at the same circumferential speed in such a way that the covering paper and the corrugated paper are moving in an identical manner at the time of their assembly. Moreover, the smooth cylinder is supported against the ribbed cylinder with a very high force, so that the pressure at the line of contact is sufficient to burst the glue cells and to simultaneously apply the covering paper firmly against the corrugated paper. Finally, this smooth cylinder is heated in order to correspondingly accelerate the setting of the glue. However, the major disadvantage of this smooth cylinder is the brutal and repetitive bumps produced at each passage of a rib of the lower cylinder, due to the force of support, which is necessarily large. Not only do these bumps damage the ridges of the corrugation of the cardboard, but they also generate a loud ambient noise. In addition, at some speeds, a resonance phenomena may occur, in the course of which the cylinders may oscillate transversely along their axle of rotation, with the result that the sheet of paper is no longer correctly applied and glued. These bumps also cause a premature wearing of the ribs of the lower cylinder.

In order to overcome these problems, smooth presses have been proposed, whose contact surface is larger than that which extends between two ribs. According to a first solution mentioned in U.S. Pat. No. 4,481,066, whose disclosure is incorporated herein by reference thereto, and described in more detail in French 2 142 591, the smooth press is made up of a crossbeam held at the ends by lower arms, and whose active surface facing the lower ribbed cylinder is cylindrically arced with a radius equal to, or even slightly greater than, that of the ribbed cylinder. By acting on the upper arms of the levers at the end by means of a pair of jacks, it is possible to bring this arcuate surface into contact with the ribbed cylinder with a predetermined pressure. The edges of the active surface can be folded toward the outside or can be provided with return rollers in order to better conduct the covering sheet. This crossbeam may also be hollow for the passage of heated steam. However, a crossbeam of this sort, being less balanced and less rigid than a cylinder, can twist and/or warp, with the result that the pressure of application is no longer uniform along the entire length of the ribbed cylinder. The quality of the gluing is then seriously affected.

According to a second solution mentioned in French Patent 2 142 591 and better described in German DE 25 27 819, the smooth press is made of an endless belt passing between upper and lower rollers situated parallel to and close to the lower ribbed cylinder, respectively, at haft-height and underneath. This belt is thus in contact with the ribbed cylinder over a quarter of the lower circumference. This endless belt can be a thin steel belt or a mat of threads of copper, cotton or synthetic fibers. However, the pressure applied to the sheets by this smooth press depends on the tension applied to the endless belt. It is, thus, advisable to provide a complex arrangement for the mechanical separation of one of the endless belt rollers in relation to the other, with the capability of adjusting this high tension to a precise value. Again, it is impossible to guarantee the maintenance of a constant tension along the entire width of the endless belt and, thus, a uniform application pressure of the covering sheet against the corrugated sheet.

SUMMARY OF THE INVENTION

The object of the present invention is to provide a smooth press for a single-sided machine for manufacturing single-sided cardboard that will be more effective and, therefore, will apply, in a temporally constant manner, a uniform pressure across the entire width of a covering sheet assembled to a corrugated sheet passing around the lower ribbed cylinder. In addition, the smooth press must permit the adjustment of the application pressure to a precise value in order to obtain an effective setting of the glue without damaging the sheets. Finally, the design of the smooth press has to be relatively simple, in order to ensure a reliable functioning over time as well as an ease of implementation and maintenance at a reasonable cost.

These goals are achieved in an improvement comprising a series of identical support arrangements arranged side-by-side along the ribbed cylinder and each arrangement comprising a pad whose surface of support against the ribbed cylinder is arced according to a radius approximately equal to that of the ribbed cylinder in order to cover a plurality of ribs, with each pad being mobile between an engaged position, and a disengaged position, under the action of an associated actuator whose active force is separately controlled.

Thus, by reason of the fact that each arrangement comprises a pad having an arcuate surface covering a plurality of ribs and an individual actuator for applying pressure, each of these support arrangements can effectively release the glue and correctly assemble the sheets by exerting for a longer time in the allocated area a pressure that is weaker but is very precise and, thus, less damaging to the ribbed cylinder and to the cardboard. The employment of a transverse series of separately controllable arrangements makes it possible to reliably ensure the application of a uniform common pressure along the entire width of the cardboard. Each arrangement comprises a structure for applying force and is less heavy than in the case of a cylinder or a single crossbeam and each arrangement can effect more rapid, better controlled corrections in order to obtain the application of a precisely predetermined pressure. In particular, such a series of small support arrangements reacts more rapidly precisely to the possible transversal or longitudinal variations in the thickness of one or both sheets.

Advantageously, the support surface of the pads is covered with or is made of a smooth material resistant to wear, such as polished metal belts of copper or stainless steel or of a synthetic material, for example marketed under the tradename Teflon.

According to a first embodiment, the support arrangement comprises a plate that carries a pad, said plate being mounted to the frame of the machine in a pivot arrangement at one of the upper and lower edges and the other edge being connected by means of a first hinge to a linear actuator, such as a jack, which itself is attached to the frame of the machine by a second hinge. The actuator will push the plate and the pad against the ribbed cylinder or pull it back. If the pad is mounted on the plate close to the pivot, then this plate operates as a lever amplifying the force exerted by the actuator, which can thus safely be dimensioned smaller for reasons of economy.

Thus, the pad is advantageously a block of elastomer whose arcuate support surface is covered with a smooth, wear-resistant material. The periphery of the pad and of its support surface can usefully be square or rectangular, oriented in the direction of the displacement or travel of the paper, and this form is easily implemented. In order to avoid any risk of spoilage of the assembled cardboard, a rhomboid shape is possible, and the pads are imbricated by means of a construction according to two superposed lines. Another possible shape is pads having curved side edges which match so that one pad has a concave curved surface matched to the convex curved surfaces of the adjacent pad.

According to a second embodiment, the support arrangement comprises a pad in the form of a belt which is held at one of its ends by a crossbeam parallel to the cylinder and fixed to the frame of the machine, and is held at the other end by a mobile crossbeam fixedly attached to the first end of a lever that pivots at its mid-point, whose other, opposite end is attached by means of a first hinge to a linear actuator, such as a jack, which itself is attached to the frame of the machine by a second hinge. The actuator lifts or lowers the first end of the lever, thus stiffening or relaxing the tension of the belt on the corrugation roll.

Advantageously, the belt may be metallic, made of copper or of polished stainless steel, or may be woven from metallic, natural or synthetic fibers, such as a mixture of fibers of carbon and of plastic fibers sold under the tradename Teflon. The belt may comprise a slightly elongated elasticity. The structure of this arrangement is particularly simple and, thus, very reliable.

According to a third embodiment, the support arrangement comprises a pad having protruding lower and upper edges, to which are affixed the two ends of a curved belt, this pad is then mounted in a pivotable arrangement at its upper or lower edge on a first half of an arm, with the other edge resting on the same half of the arm across an elastic means, such as a spring or a block of elastomer. The end of the other half of the arm is fixed in a pivot arrangement to the frame of the machine, with the first half of the arm being attached by a first hinge to a subjacent linear actuator, such as a jack, which itself is attached to the frame and pushes the first half of the arm and, thus, the pad against the ribbed cylinder or pulls the first half and the pad away from the cylinder.

Preferably, the braking force of the cardboard induced by the frictional force generated at the level of the smooth press according to the invention is compensated by the fact that the cardboard is drawn downstream from the ribbed cylinder and from the smooth press by a tractor arrangement, in particular by a calendar roll composed of a traction cylinder, around which the cardboard is wound by contact with its upper covering paper on at least a third of the circumference of the cylinder. The tractor device further comprises a flexible support roller in contact with the crests or flutes of the corrugated paper. The covering paper is usually led toward the smooth press by an upstream pre-heating and guiding cylinder that defines, together with the downstream tractor roller, a tension or contact angle e of the covering paper and, thus, the angle at the vertex of the part of the ribbed cylinder with which the covering paper is in contact is greater than 30°. The tension present in the covering paper thus creates a supplemental pressure of application.

Advantageously, the support surface of the pad is arced according to an angle at the vertex corresponding to the tension or contact angle of the covering paper. The width of the support surface is preferably between 100 mm and 200 mm. When the support surface of the pad is arced according to an angle at the vertex smaller than the angle of the tension, the smooth press according to the present invention can be arranged in the downstream part of the contact surface in order to arrange at the beginning, upstream from this surface, a flexible roller for the first application of the covering paper. Alternatively, the guiding cylinder and the flexible roller are replaced by a single smooth cylinder identical to that used in the prior art, but held close to the ribbed cylinder with an amount of play just sufficient to ensure a first application of the covering paper against the corrugated paper, but with a pressure that is practically negligible.

Other advantages and features of the invention will be readily apparent from the following description of the preferred embodiments, the drawings and claims.

BRIEF DESCRIPTION OF THE DRAWINGS

FIG. 2 is a side view of a second embodiment of a smooth press in accordance with the present invention;

FIG. 3 is a side view of a third embodiment of a smooth press in accordance with the present invention;

DESCRIPTION OF THE PREFERRED EMBODIMENTS

Figure 1:
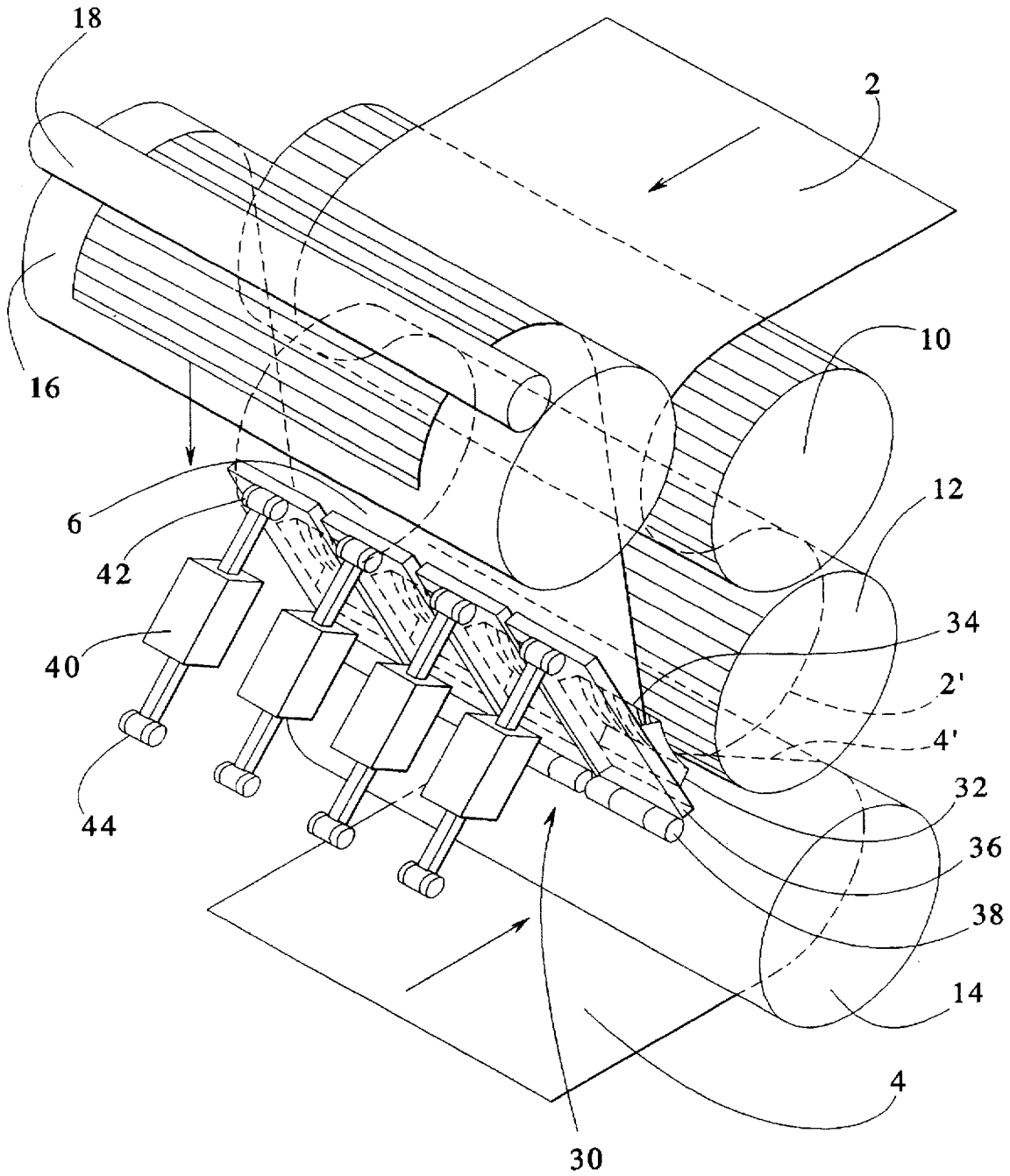
FIG. 1 is a perspective view of a single-sided machine including a smooth press according to the first embodiment of the present invention.

A manufacturing machine, which is so-called single-sided, is illustrated in schematic perspective view in FIG. 1 and is intended for the manufacture of a piece of cardboard 6, also called single-sided, which cardboard is made up of an assemblage of a corrugated paper 2 and a covering paper 4. More precisely, the corrugated paper 2 comes in at the top and makes a first half-turn around an upper ribbed cylinder or corrugating roll 10, and this paper 2 is corrugated at the point at which the upper cylinder 10 meshes with a second, lower ribbed cylinder 12. The corrugated paper 2' thus shaped is held against the lower cylinder 12 during a second half-turn downward by an arrangement (not shown), which may consist of combs, of an exterior excess pressure created in a casing box or by a partial vacuum applied to the interior of the lower ribbed cylinder, which will have radial openings to permit the suction of the paper into the grooves of the corrugated ribs. During the second half-turn, a glue-spreading roller 13 (see FIGS. 2–4) deposits a line of glue on each ridge or flute of the corrugations. Moreover, a covering paper 4 is pre-heated during its rotation around a cylinder 14 and then guided toward the lower part of the lower ribbed cylinder 12 so as to arrive fully parallel to the corrugated paper 2', against which the cover paper 4' is finally placed. At this point, a smooth press is present.

In the invention, the smooth press comprises a plurality of laterally arranged series of support groups 30, which apply a predetermined pressure that is necessary and sufficient, on the one hand, to burst the glue cells and, on the other hand, to firmly hold the two sheets of paper against one another during the setting of the glue threads that attach the flutes of the corrugated sheet to the cover sheet. More particularly, according to the present invention, the exiting piece of cardboard 6 is drawn downstream by a calendar made up of a traction cylinder 16 coacting with a flexible support roller 18. The piece of cardboard 6 thus rolls by means of its more solid covering paper around the upper half of the traction cylinder 16. The contact pressure between this piece of cardboard and the traction cylinder is reinforced by the support of the roller 18 acting against the more fragile corrugated flutes of the paper. This support roller comprises a circumference made of elastomer, connected in its central shaft by a series of radial longitudinally extending blades, also made of elastomer, whose transverse section is oblique or even curved.

According to a first embodiment shown in FIG. 1, the smooth press is composed of a series of support groups 30 arranged side-by-side along the lower, downstream part of the ribbed cylinder 12. Each support group 30 comprises a plate 36 whose lower edge is mounted for rotation by means of a pivot 38 on a first common crossbeam, which is fixedly secured to the frame of the machine. The upper edge of each plate 36 is attached to a second common crossbeam, which is fixedly attached to the frame of the machine by means of an individual associated jack 40. Each jack 40 has a cylinder attached to the lower crossbeam by a hinge 44 and a ram or rod attached to the upper edge of the associated plate by a second hinge 42 or has the rod attached to the hinge 44 and the cylinder attached to the hinge 42. Thus, the extension of the rod out of the cylinder of the jack permits the plate 36 to be brought closer in the direction of the lower ribbed cylinder 12 by rotation around its lower pivot 38, while a retraction of the rod into the cylinder of the jack carries the plate 36 further away, accompanied by a slight lowering of the jack 40 by rotation around its lower hinge 44.

As is clearly shown in FIG. 1, the lower part of each plate 36 carries a pad 32, whose base is fixed against the plate and has a rectangular shape whose length is parallel to the direction of the travel of the cardboard 6. On the other hand, the surface 34 facing the ribbed cylinder is curved so as to form a portion of a cylinder having a radius that is approximately equal to or even slightly greater than that of the cylinder 12. The active support surface 34, which places the covering paper 4' against the flutes of the corrugated paper 2', is preferably a surface presenting a low coefficient of friction as well as a high resistance to wear. For example, this surface may be metallic, polished or a layer of synthetic material, such as sold under the tradename Teflon. While the body of the pad may be metallic, it is preferable to use a block of elastomer presenting a relative elasticity, making it possible to absorb any residual vibration due to the speed or to accidental variations of thickness of one paper or the other.

Figure 5:
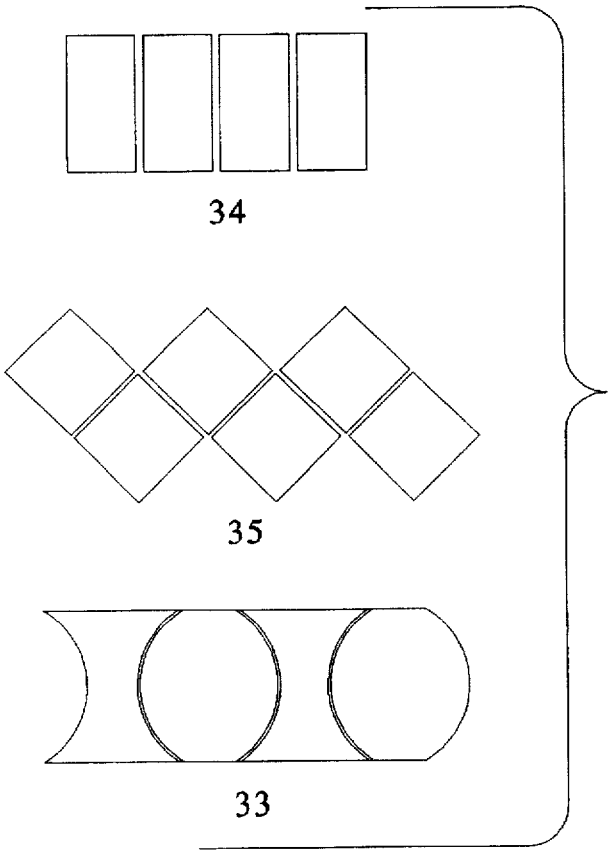
FIG. 5 illustrates constructions of pads used in the first embodiment of FIG. 1.

As shown in FIG. 5, the side-by-side rectangular active surfaces 34 together define a support zone in which the pressure may be sufficiently high to release the glue but sufficiently moderate to damage neither the cardboard nor the ribs of the lower cylinder 12. If the possible formation of striations in the covering sheet of the cardboard is feared, due to possible momentary differences in the pressure of one support group on the pad, the pads may also possess other shapes comprising lateral oblique sides, with the result that the transition from one pad to the other is distributed across a certain width. For example, pads 35 having the shape of rhomboids arranged along two imbricated lines would be possible, as would side-by-side pads 33 having laterally curved edges, whose pads alternatively have a convex oval shape and a concave thinned shape. Pads having meshing S-shaped edges are also possible.

A second embodiment of the support groups 50 is shown in FIG. 2. This embodiment is based on the pads in the form of a rectangular curved belt 58, which is oriented in the direction of the unwinding of the paper. The lower end of the belt 58 is attached to a first fixed crossbeam 56 having a width equal to that of the belt. Conversely, the upper end of the belt is fixed to a crossbeam 54, which is mobile due to the fact that it is fixed to the end of a first branch of a lever 52 that pivots around an axle situated at the end of a stay or support 51. The opposite end of the second branch of the lever is connected to the frame of the machine by a jack 40 articulated on two hinges, with a lower hinge 44 connecting a cylinder to the base and an upper hinge 42 connecting a rod or ram to the lever. The branch of the lever that holds the crossbeam may have a length of between one-half and one-quarter, and preferably one-third of the total length of the lever so as to obtain an effect of an amplification of the force applied by the jack 40 to the belt 58 in order to stiffen the belt against the lower ribbed cylinder 12. In order to facilitate the entrance and exit of the paper in this support group 50, the crossbeam 54 and 56 present round upper surfaces, with the result that the ends of the belt 58 are curved toward the exterior. As shown, the length of the belt 58 is approximately equal to the arc of tension or contact e of the contact surface of the covering paper 4 against the cylinder 12, as defined by the respective position of the pre-heating and guiding cylinder 14 and of the traction cylinder 16 in relation to the lower ribbed cylinder 12.

A third embodiment of the support is a support group 60, as illustrated in FIG. 3, and this embodiment has an arm 64 rotatably mounted around a pivot 66 of an upper base. The lower half of the arm 64 carries a pad 61 mounted in a pivotable arrangement around a hinge 65 close to an upper edge, while its lower edge rests against an elastic means 63, such as a row of springs or a rubber stop, which means is provided on the arm 64.

Moreover, the upper and lower edges of the pad 61 are formed from transverse protuberances with rounded ends, on which are fixed the corresponding rounded edges of a belt 62 that constitutes the surface of application of the covering paper 4 against the corrugated paper 2. The arm 64 is moreover attached to a crossbeam of the frame of the machine by a jack 40 articulated on two hinges, with a lower hinge 44 and an upper hinge 42. The hinge 42 and thus the point of action of the jack 40, is situated approximately at the mid-point of the pad 61 in order to push the pad in a balanced manner against the lower ribbed cylinder 12.

The application belt 62 in this embodiment, as well as the belt 58 in the preceding embodiment, is preferably made of a metallic substance, such as copper or polished steel. Alternatively, these belts may also be woven from threads or fibers, which may be metallic or may be of Teflon reinforced with carbon or other synthetic fibers which have a low frictional coefficient and a high resistance to wear. In the embodiment shown in FIG. 3, the active length of the belt 62 covers an angle e', which is only a downstream fraction between two-thirds and three-quarters of the tension or contact angle e of the covering paper 4 against the cylinder 12, as defined by the relative position of the upstream guiding roller 15 and the downstream traction roller 16 in relation to the lower ribbed cylinder 12. In fact, the bursting of the glue cells is effected at this point by a flexible application roller 11, which is constructed similar to the roller 18 and situated vertically underneath the ribbed cylinder 12. The pressure applied by the support groups 60 is thus established by a value just sufficient to ensure the firm holding of the covering paper 4 against the corrugated paper 2 during the setting of the glue.

Finally, in this embodiment, the guiding cylinder 15 is smaller than the guiding cylinder 14 in the preceding embodiment. This is due to the fact that the pre-heating is accomplished by a heating table 17 situated upstream.

Figure 4:
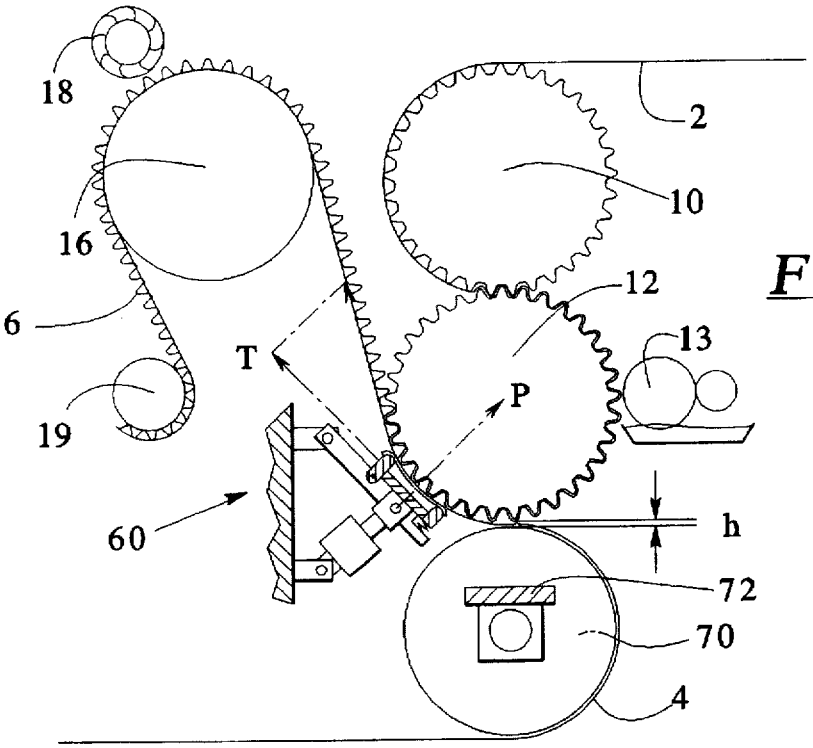
FIG. 4 is a side view of a smooth press according to FIG. 3 installed in a modified machine.

A variation of the embodiment of FIG. 3 is shown in FIG. 4 and employs a series of supports 60. In FIG. 4, the guide roller 15 and the heating table 17 are replaced by a smooth cylinder 70 according to the prior art. However, the smooth cylinder 70 is mounted on bearings 72, which are vertically movable according to a servomechanism. The servomechanism enables the cylinder 70 to be led close to the lower ribbed cylinder 12 at a precisely predetermined and controlled distance h. This amount of play h is established so that the smooth cylinder brings into contact only the preheated covering paper 4 and the corrugated paper 2 and applies a force just necessary to burst the glue cells, but in any case sufficiently weak to avoid risking damage to the cardboard 6 or the ribs. In addition, an exit return idler 19, situated downstream from the calendar cylinders 16 and 18, will increase the angle of the tension of the cardboard around the traction cylinder 16 so as to induce in this cardboard a high tension T that generates an additional pressure resultant P at the point of the contact surface of the setting of the glue against the lower ribbed cylinder 12.

Although various minor modifications may be suggested by those versed in the art, it should be understood that we wish to embody within the scope of the patent granted hereon all such modifications as reasonably and properly come within the scope of our contribution to the art.

We claim:

1. In a smooth press in a single-sided machine for manufacturing corrugated cardboard, said smooth press implementing the application of a cover paper against the corrugated paper passing around a ribbed cylinder, the improvements comprising the smooth press being formed by a series of identical support arrangements arranged side-by-side along an axis of the ribbed cylinder, each arrangement having a pad with a curved support surface, each pad having a belt and means for holding each end of the belt affixed to form said curved support surface, said support surface having an arc according to a radius approximately equal to that of the ribbed cylinder in order to cover a plurality of ribs of said cylinder, each arrangement having means for mounting the pad for movement between a position engaged with the cylinder and a position disengaged therefrom and each arrangement having means for moving the pad between said positions with a separately controllable active force.

2. In a smooth press according to claim 1, wherein the support arrangement comprises a plate having one edge mounted by a pivot to a frame of the machine, the opposite edge being connected by a first hinge to a linear actuator which in turn is attached to the frame of the machine by a second hinge, said actuator forming the means for moving the pad between said positions.

3. In a smooth press according to claim 2, wherein a periphery of the pad and of the support surface is a rectangle oriented with the long side of the rectangle extending in the direction of travel of the paper on the ribbed cylinder.

4. In a smooth press according to claim 2, wherein a periphery of each of the pads is a rhomboid, said pads being imbricated along two superposed lines.

5. In a smooth press according to claim 2, wherein each of the pads has curved edges mating with adjacent pads with alternate pads having an oval shape.

6. In a smooth press according to claim 1, wherein the support arrangement comprises the pad held on one end by a crossbeam extending parallel to the cylinder and affixed to the frame of the machine and at least the other end by a movable crossbeam attached fixedly to a first end of a lever that is mounted to pivot around the point between the ends of the lever, said lever, at an opposite end, being connected by a first hinge to a linear actuator forming the means for moving, said linear actuator being attached to the frame by a second hinge, said actuator thus lifting and lowering the first end of the lever to change a tension applied to the belt.

7. In a smooth press according to claim 6, wherein the belt is woven of fibers selected from a group consisting of metallic fibers, natural fibers and synthetic fibers.

8. In a smooth press according to claim 1, wherein each support arrangement comprises the pad having protruding upper and lower edges, the two ends of the curved belt affixed to said edges with the belt extending therebetween, said pad being mounted in a pivotable arrangement at one of its edges on a first half of an arm, the other edge resting on elastic means for biasing the pad away from said arm, the end of the other half of the arm being fixed in a pivotable arrangement to the frame of the machine, the first half of the arm being attached by a first hinge to a linear actuator of the means for moving, which actuator is attached to the frame of the machine by a second hinge, said actuator being movable for pushing said first half of the arm and the pad against the ribbed cylinder and for moving the pad away from the cylinder.

9. A single-sided corrugating machine having means for corrugating a sheet, means for guiding a covering sheet onto the corrugated sheet, means for drawing the single-sided cardboard downstream from the ribbed cylinder including a tractor cylinder around which the cardboard is wound by contact with the covering paper on at least a third of the circumference of said tractor cylinder and a radial flexible support roller in contact with the corrugated flutes of said paper, and a smooth press for urging the cover sheet onto the corrugated paper on the ribbed cylinder, said smooth press comprising a series of identical support arrangements arranged side-by-side along the axis of the ribbed cylinder, each arrangement comprising a pad having a curved support surface of a radius approximately equal to that of the ribbed cylinder for engaging the cylinder and having a length to cover a plurality of ribs, each curved support surface being a belt affixed at each end to the pad, each pad being mounted for movement between a position retracted from the ribbed cylinder and a position engaged with the ribbed cylinder, and means separately controllable for shifting each pad between said positions.

10. A single-sided machine according to claim 9, wherein the means for guiding the covering paper includes an upstream pre-heating and guiding cylinder which, together with a downstream tractor cylinder, define a contact angle e greater than 30° for the covering paper and the ribbed cylinder.

11. A single-sided machine according to claim 10, wherein the upstream pre-heating and guiding cylinder is mounted close to the ribbed cylinder with an amount of play h sufficient to ensure a first application of the covering paper against the corrugated paper, but with a pressure that is practically negligible.

12. A single-sided machine according to claim 9, wherein each of the support arrangements comprises a plate carrying the pad, said plate being mounted on a pivot along one edge and having the opposite edge connected by a hinge to a linear actuator forming the means for shifting, said linear actuator being connected to the frame by a second hinge.

13. A single-sided machine according to claim 9, wherein the support arrangement comprises the pad held at one end by a crossbeam parallel to the cylinder and fixed to the frame of the machine and the other end by a mobile crossbeam fixed to a first end of a lever, said lever being mounted for pivoting around a point between ends of the lever and having an opposite end attached by a first hinge to a linear actuator forming the means for shifting, said linear actuator being attached to the frame of the machine by a second hinge.

14. A single-sided machine according to claim 9, wherein the support arrangement comprises the pad having protruding upper and lower edges, the curved belt being mounted between said upper and lower edges, said pad being mounted in a pivotable arrangement at one edge on a first half of an arm, the other edge resting against an elastic means, said arm being mounted in a pivotable arrangement to a frame of the machine, a first half of the arm being attached by a first hinge to a linear actuator forming said means for shifting, the linear actuator being mounted to the machine by a second hinge.

15. In a smooth press according to claim 1, wherein the means for holding each end comprises protruding upper and lower of edges a member with the belt extending therebetween, said member being mounted in a pivotable arrangement at one of the edges on a first half of an arm, the other edge resting on elastic means for biasing the member away from said arm, the end of the other half of the arm being fixed in a pivotable arrangement to the frame of the machine, the first half of the arm being attached by a first hinge to a linear actuator of the means for moving, which actuator is attached to the frame of the machine by a second hinge, said actuator being movable for pushing said first half of the arm and the belt against the ribbed cylinder and for moving the belt away from said cylinder.

16. In a smooth press according to claim 15, which includes a guide roller and heating plate for contacting the cover paper prior to reaching the ribbed cylinder.

17. A single-sided corrugating machine according to claim 9, wherein the pad has upper and lower edges for mounting the belt, said pad being mounted in a pivotable arrangement at one edge on a first half of an arm, the other edge resting against an elastic means, said arm being mounted in a pivotable arrangement to a frame of the machine, a first half of the arm being attached by a first hinge to a linear actuator forming said means for shifting, the linear actuator being mounted to the machine by a second hinge, and said machine including means for heating the covering sheet prior to engaging the corrugated sheet.

* * * * *